United States Patent [19]

Sawada

[11] Patent Number: 4,686,813

[45] Date of Patent: Aug. 18, 1987

[54] ROBOT SYSTEM FOR ENCASING CONE-LIKE ARTICLES

[75] Inventor: Morio Sawada, Kako, Japan

[73] Assignee: Murata Kikai Kabushiki Kaisha, Kyoto, Japan

[21] Appl. No.: 836,340

[22] Filed: Mar. 5, 1986

[30] Foreign Application Priority Data

Mar. 11, 1985 [JP] Japan ..... 60-48747

[51] Int. Cl.[4] ..... B65B 35/36; B65B 35/58

[52] U.S. Cl. ..... 53/446; 53/473; 53/143; 53/539; 53/543; 53/544; 53/247

[58] Field of Search ..... 53/143, 538, 537, 544, 53/539, 247, 446, 448, 473, 543

[56] References Cited

U.S. PATENT DOCUMENTS 3,443,355 5/1969 Birrell ..... 53/143 X
3,802,154 4/1974 Dillon ..... 53/143 X
3,878,665 4/1975 Couten ..... 53/143
4,002,005 1/1977 Mueller et al. ..... 53/143 X
4,435,941 3/1984 Booth et al. ..... 53/247 X

FOREIGN PATENT DOCUMENTS 2534877 4/1984 France ..... 53/143

*Primary Examiner*—Horace M. Culver

[57] ABSTRACT

A robot system for encasing cone-like articles, comprising a robot movable along a path, and an aligning and supplying device for cone-like articles, empty cases for receiving the cone-like articles and an inverting device for carrying and inverting the plurality of cone-like articles which are disposed along the path of the robot. The robot includes a first gripper for gripping and carrying the cone-like articles aligned on the aligning and supplying device and a second gripper for gripping and carrying the cone-like articles inverted on the inverting device.

14 Claims, 10 Drawing Figures

ROBOT SYSTEM FOR ENCASING CONE-LIKE ARTICLES

FIELD OF THE INVENTION AND RELATED ART STATEMENT

This invention relates to a encasing system for cone-like articles using a robot.

As to encasing cone-like articles such as yarn packages, considerations have been made so that erected and inverted cone-like articles are alternately inserted in a case to enhance the article packing rate in the case and at the same time prevent shaking of the articles therein.

Accordingly, the aforesaid method is the best method to encase the cone-like articles, but if the inserting and placing position of the upright cone-like article into the first case is not accurate, insertion of the inverted cone-like articles to be inserted later becomes incomplete. In addition, even if the position of the cone-like articles placed firstly, when the inserting position or the inverted attitude for insertion of the inverted cone-like articles to be inserted later, namely, when the articles are inserted obliquely, the insertion of the inverted cone-like article becomes incomplete to fail to accomplish complete encasing operation. Particularly, where a number of and a multiplicity of rows of articles are encased, the aforesaid incomplete inserting conditions tends to be accumulated, and therefore, it has been difficult, in the encasing of a number of cone-like articles, to realize the above-described encasing method by a normal industrial robot. Even if it should be realized, operation by the robot of inserting articles one by one takes a considerable time, failing to expect quickness. Particularly, in case that cone-like articles to be handled are yarn packages or the like, and more than two kinds of articles substantially different in outside diameter are encased into cases different in size and in different arrangements, such a difficulty as noted above further increases.

OBJECT AND SUMMARY OF THE INVENTION

It is an object of the present invention to provide a new encasing robot system in which even when the encasing method as described above is effected in respect of a number of articles in many stages, the complete encasing operation is well effected, and even if the arranging pitch into the cases is changed due to the variety in diameter of articles to be handled, the system may easily correspond to such change.

According to the present invention, there is provided a robot system for encasing cone-like articles, the system comprising an aligning and supplying device for cone-like articles along a moving path of a robot, empty cases for receiving said cone-like articles, and an inverting device for carrying and inverting said plurality of cone-like articles, characterized in that said robot comprises a first gripper for gripping and carrying the cone-like articles aligned on the aligning and supplying device and a second gripper for gripping and carrying the cone-like articles inverted on said inverting device, said first gripper being provided with a pitch changing device for the plurality of cone-like articles gripped, and said inverting device being provided with a plurality of article carrying surfaces for carrying the plurality of cone-like articles different in arranging pitch.

DETAILED DESCRIPTION OF PREFERRED EMBODIMENTS

Figure 1:
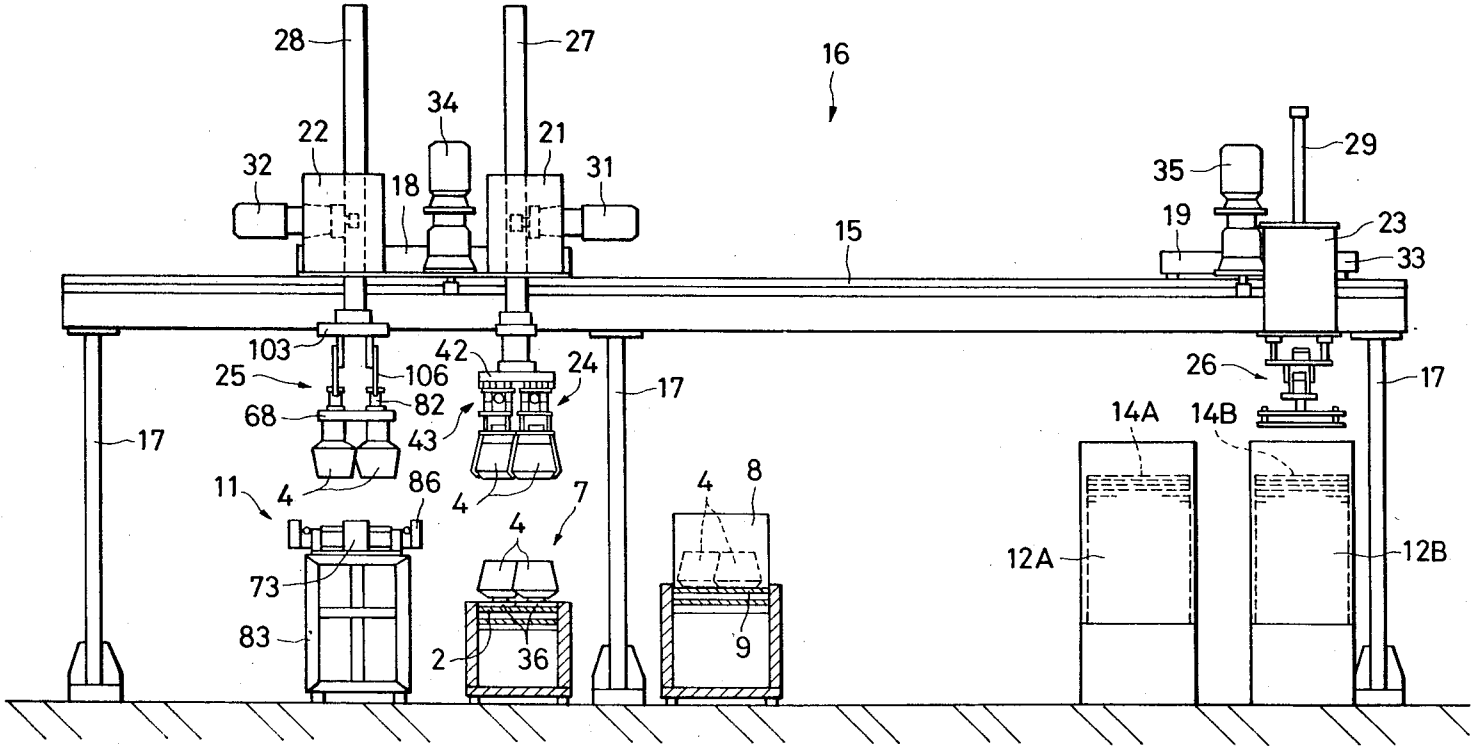
FIG. 1 is a front view of a encasing robot system.
Figure 3:
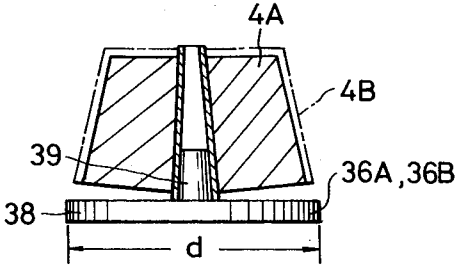
FIG. 3 is a longitudinal sectional view of cones stood on a bobbin tray.
Figure 2:
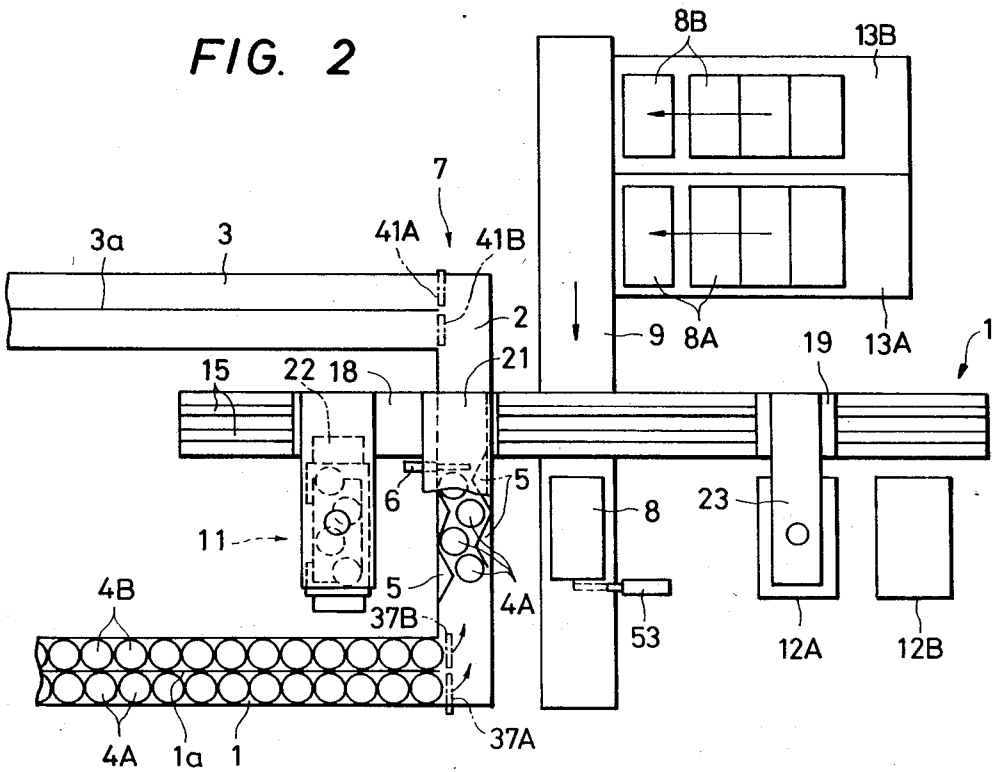
FIG. 2 is a plan view showing the arrangement thereof.

FIGS. 1 and 2 are a side view and a plan view, respectively, of a robot system for encasing cones in accordance with the present invention. This embodiment handles a yarn package wound by a yarn winding machine as a cone-like article.

On the floor are arranged three belt conveyors 1,2 and 3 provided continuously in a laterally directed U-shaped fashion, triangular baffles 5 for arranging in a zig-zag manner said yarn package cones 4 provided on the belt conveyors 1 to 3, a device 7 for aligning and supplying the cones 4 comprising a stopper cylinder 6, a belt conveyor 9 for supplying a receiving empty case 8, the conveyor 9 travelling parallel to the belt conveyor 2, an inverting device 11 for cones which will be described later, and stacking boxes 12A and 12B for partitioning cardboards. Reference numerals 13A and 13B designate empty-case stocking conveyors, respectively, for stocking empty-cases 8A for encasing 16 ($8\times2$ stages) cones and empty cases 8B for encasing 12 ($6\times2$ rows) cones and transferring one by one onto the conveyor 9 at suitable time. Partitioning cardboards for the empty cases 8A and 8B different in shape and size are put into and stacked in a stacking box 12A and a stacking box 12B for the empty case 8A and the empty case 8B, respectively.

A cross coordinate type robot 16 is installed which has an overhead rail 15 extending between the inverting device 11 and the cardboard stacking boxes 12A and 12B. Reference numeral 17 designates a support column for the rail 15, and reference numerals 18, 19 designate movable frames which move along the rail 15. The movable frames 18, 19 have cantilever arms 21, 22 and 23 extended in a direction cross to the rail 15. Supported movably up and down on these arms 21, 22 and 23 are a cone gripping gripper 24 on the aligning and supplying device 7, an inverting bed gripping gripper 25 on the inverting device 11 and a cardboard attraction head 26. Reference numerals 27, 28 and 29 designate arms for moving up and down the grippers 24 and 25 and the attraction head 26; 31, 32 and 33, motors for vertically moving and driving the arms 27, 28 and 29; and 34, 35, motors for travelling and driving the movable frames 18 and 19. Since in this embodiment, the aligning and supplying device 7, the empty-box supplying belt conveyor 9, the inverting device 11 and the cardboard stacking boxes 12A and 12B are justaposed substantially on a straight line, the grippers 24 and 25 and the attraction head 26 need not be moved in the direction along the cantilever arms 21, 22 and 23 and may be moved only up and down at the ends of the arms 21, 22 and 23. However, the devices 7, 9, 11, 12A and 12B are arranged to be different from the former, the grippers 24, 25 and the attraction head 26 may be designed so that they are moved in a longitudinal direction of the arms 21, 22 and 23.

While in the above-described embodiment, the arms 21 and 22 supporting the grippers 24 and 25 thereon are secured to a common movable frame 18, it is to be noted that these arms may be secured to separate movable frames so that the grippers 24 and 25 may be independently moved on the rail 15.

In the following, the above-described devices and grippers will be further described.

First, the aligning and supplying device 7 for the cones 4 comprises three belt conveyors, i.e., a loading conveyor 1, an aligning conveyor 2, and a belt conveyor 3 for carrying bobbin trays 36A and 36B, as described above, whereby cones 4A of kind A and cones 4B of kind B different in a winding shape are separately stocked on the loading conveyor 1 which is substantially divided by a central separating plate 1*a* into two carrying paths. In this embodiment, when 16 cones 4A of kind A (which has a small diameter) are collected, a gate 37A at the end of the conveyor 1 is actuated to be opened and closed at suitable intervals to feed four cones 4A each time to the aligning belt conveyor 2 in synchronism with encasing timing by the robot which will be described later, whereas when 12 cones of kind B (which has a large diameter) are collected, a gate 37B is likewise actuated to be opened and closed at suitable intervals to feed three cones 4B each time to the aligning belt conveyor 2.

The bobbin trays 36A and 36B have a projection 39 for allowing a cone to stand upright in the center of and on a disc 38. The bobbin tray 36A for the cones 4A of kind A and the bobbin tray 36B for the cones 4B of kind B have their projections 39 which have shapes different from each other so that the projections are adjusted to core-tube shapes of the cones 4A and 4B, respectively, for close fitting therebetween but the discs 38 have the same diameter (d).

Accordingly, the different cones 4A and 4B delivered onto the aligning belt conveyor 2 are arrayed in the same zig-zag fashion on the conveyor 2 since the disc portions of the bobbin trays 36A and 36B are controlled in advancement by the baffles 5 and the forward movement thereof is impaired by the extention of the stopper cylinder 6 provided at the foremost portion of the baffles 5. As previously mentioned, four cones 4A of kind A and three cones 4B of kind B are arrayed each time.

The bobbin trays 36A and 36B from which the cones 4A and 4B are removed and raised by the gripper 24 which will be described later are again moved forward by the withdrawal of the stopper cylinder 6 and reach the carrying belt conveyor 3. This carrying belt conveyor 3 is also substantially divided by the central separating plate 3*a* into two carrying paths, and gates 41A and 41B are provided at inlets of the carrying paths, respectively so that the bobbin trays 36A and 36B for the cones different in kind may be separated into the respective paths and independently recovered.

Next, the gripper 24 will be described in detail in which upright cones 4A and 4B aligned by the aligning and supplying device 7 are removed from the bobbin trays, raised and transported.

Figure 4:
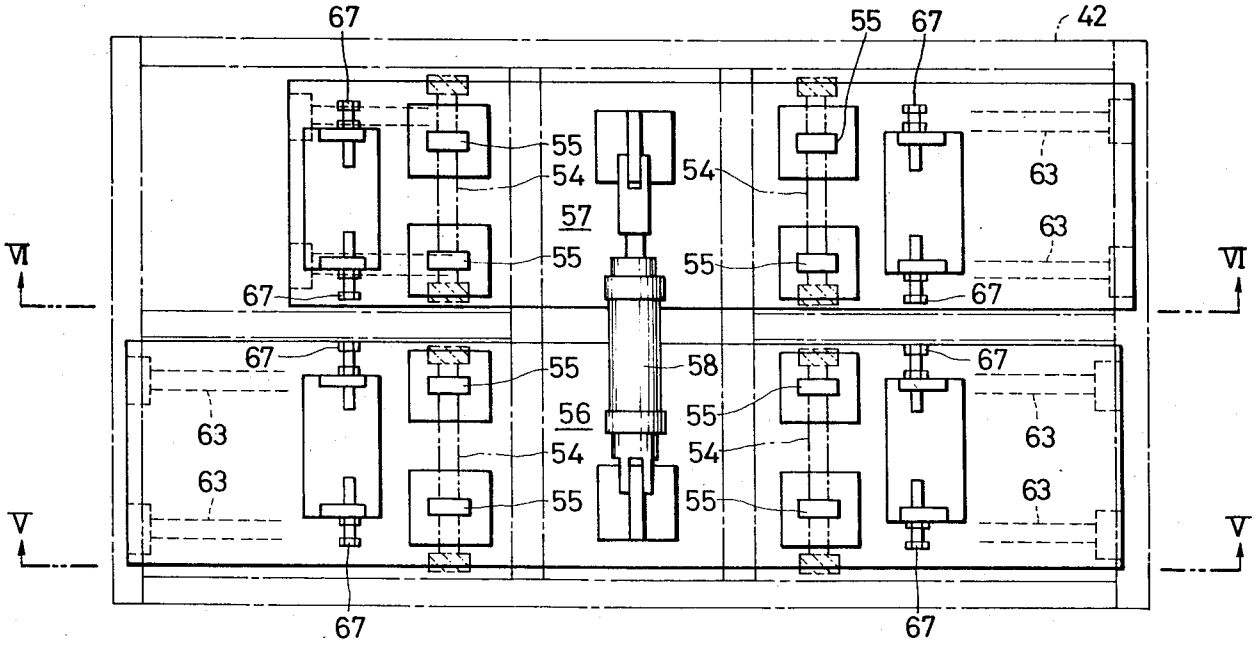
FIG. 4 is a plan view without a support frame for a gripper which grips and transports upright cones.
Figure 5:
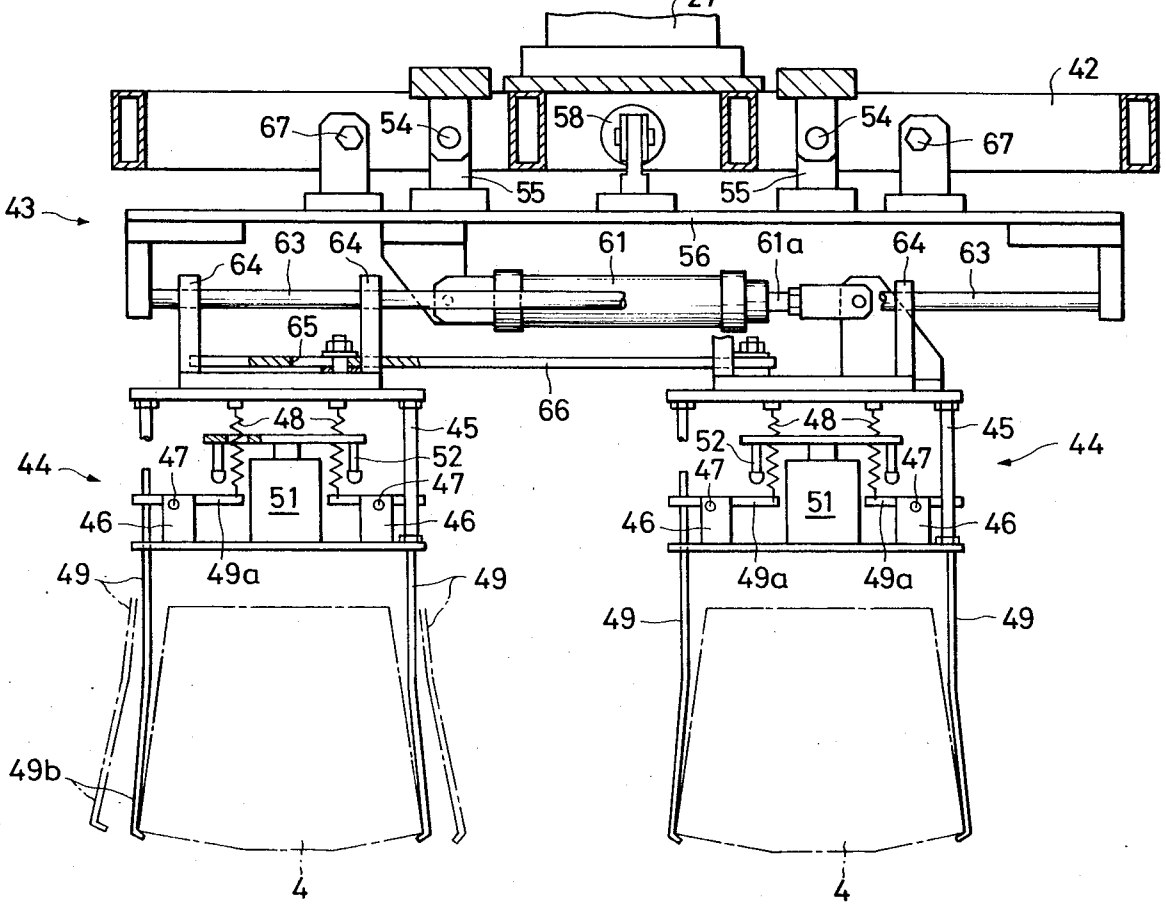
FIG. 5 is a longitudinal sectional view of the gripper taken on a lines V—V of FIG. 4.
Figure 6:
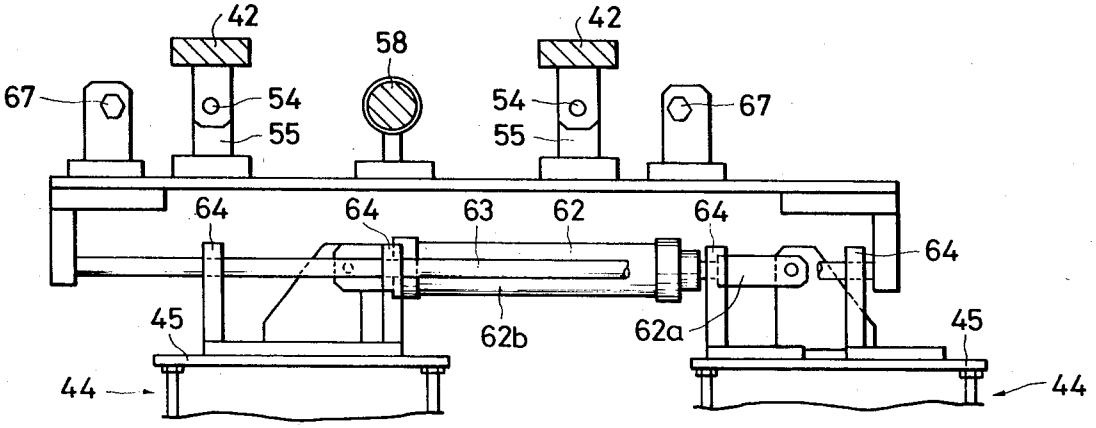
FIG. 6 is a longitudinal sectional view of the gripper taken on a line VI—VI of FIG. 4.

As shown in FIGS. 4 to 6, the gripper 24 comprises a support frame 42 secured to the lower end of the arm 27 and four gripper units 44 suspended through a pitch changing device 43 on the support frame 42. Each of the gripper units 44 is designed so that four lever pawls 49 lower ends of which are journalled by means of a bracket 46 on a frame 45 so as to be opened and closed swingingly and being biased in a closing direction by means of springs 48 catch and engage sides and peripheral edges of a bottom of the cone 4 from four sides (see the solid line in FIG. 5), and the other end 49*a* of the lever pawl 49 is pushed down through a press-down element 52 by the contraction of a cylinder 51 whereby when a lower end (49*b*) of the lever pawl is opened (see the chain line in FIG. 5), the cone 4 is released. Each of the gripper units 44 is further designed so that a position thereof in a horizontal plane with respect to the support frame 42 may be switched and changed into two positions by the pitch changing device 43 which will be described hereinafter.

Figure 7:
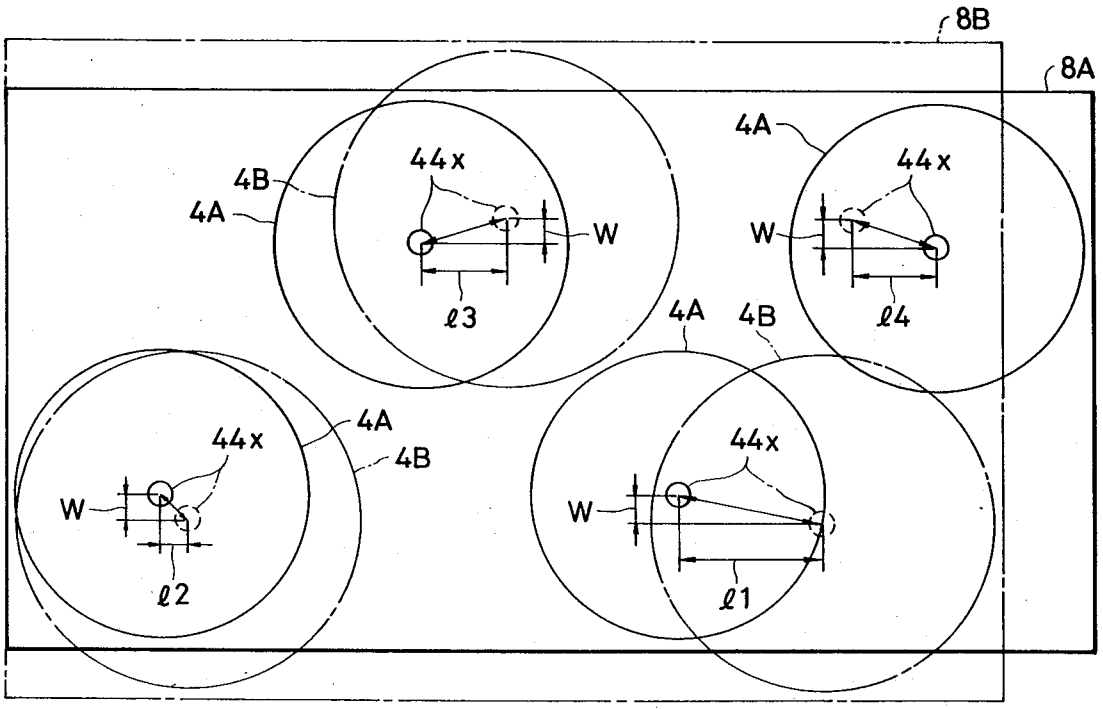
FIG. 7 illustrated the arrangement of reception of cones into cases and the array of corresponding gripper units.

More specifically, reception and arrangement of cones into empty cases 8A and 8B different in size according to the kinds are as shown in FIG. 7. In the figure, the arrangement of empty cases for kind A, cones and center 44x of the gripper unit is indicated by the solid lines whereas the arrangement of empty cases for kind B, cones and center 44x of the gripper unit is indicated by the chain line, and as for the cones, only the upright cones on the first row are shown as a typical example. Since each of the empty cases 8A and 8B is stopped by a stopper cylinder 53 on the belt conveyor 9 in the same position with one end as a reference, the cone 4B of kind B whose diameter is large assumes a receiving arrangement widened vertically in FIG. 7 as compared with the cone 4A of kind A whose diameter is small, and assumes a receiving arrangement deviated to right in FIG. 7 in a lateral direction.

In view of the above, in the pitch changing device 43 in this embodiment, two movable frames 56 and 57 which are movable widthwise of the case are provided on the support frame 42 through a guide bar 54 and a slide bracket 55, two gripper units 44 and 44 for handling the lower cone 4A or 4B in FIG. 7 are supported on one and the same movable frame 56, and two gripper units 44 and 44 for handling the upper cone 4A or 4B are supported on the other one and same movable frame 57 whereby the pitch widthwise of the case of each gripper unit 44 may be collectively changed by the same amount W (FIG. 7) by expansion of a cylinder 58 provided between the two movable frames 56 and 57. With respect to the pitch lengthwise of the case, position changing cylinders 61 and 62 are provided between the movable frames 56, 57 and the gripper unit 44.

More specifically, in each of the gripper units 44, the frame 45 is supported movably lengthwise of the case on the movable frames 56 and 57 through a guide bar 63 and a slide bracket 64. With respect to the gripper units 44 and 44 for handling the cone 4A or 4B on the side of the movable frame 56, that is, on the lower side in FIG. 7, upper portions of the frame 45 thereof are loosely connected through a connecting plate 66 bored with a play slot 65, and a cylinder 61 is disposed between one frame 45 and the movable frame 56 whereby the gripper unit 44 to which a rod 61*a* is directly coupled is moved lengthwise of the case through the expansion amount l1 (FIG. 7) of the cylinder by the expansion of the latter, and the gripper unit 44 loosely connected through the connecting plate 66 is moved lengthwise of the box through the amount l2 (FIG. 7) obtained by deducting the length of the slot 65 from the expansion amount of the cylinder.

With respect to the gripper units 44 and 44 for handling the cone 4A or 4B on the side of the movable frame 57, that is, on the upper side in FIG. 7, upper portions of the frame 45 are directly connected by a cylinder 62 as shown in FIG. 6, and the gripper units 44 are moved to and away from each other, through the amount controlled by a stopper not shown provided on the guide bar 63, by the expansion of the cylinder 62. That is, the gripper unit 44 in which a body **62*b* of the cylinder 62 is connected is moved lengthwise of the case through the length l3 (FIG. 7) whereas the gripper unit 44 in which a rod 62*a* of the cylinder 62 is connected is moved through the amount l4 (FIG. 7) obtained by deducting the aforesaid length l3 from the expansion amount of the cylinder 62. However, by movement of the gripper unit 44 toward the inside of the case through the length l4, impingement of the gripper unit 44 against the peripheral wall of the case 8B is avoided when the cones are inserted into the empty case 8B of kind B. Reference numeral 67 designates a position control stopper bolt for the support frame 42 of the movable frames 56 and 57**.

As described above, the pitch changing device 43 in this embodiment comprises the movable frames 56, 57; the cylinder 58 interposed therebetween; and the cylinders 61, 62 connected to the gripper units 44, respectively, supported on the movable frames 56, 57. It will be however noted where a multiplicity of cylinders may be used that the grippers 44 may be mounted on the support frame 42 so that the gripper units may be moved along in the moving direction (FIG. 7), and cylinders moving in said moving direction may be connected one by one to the respective gripper units 44. In this case, if a design is made so that the stroke of the cylinder may be expanded stepwise, the arrangement of the gripper units may be changed to be switched into more than three kinds.

Moreover, the construction of each of the gripper units 44 is not limited to the lever pawls 49 which are swingingly opened and closed as described above but it can be of the outwardly opening type in which a core tube of the cone 4 may be held from the inside, for example.

Figure 8:
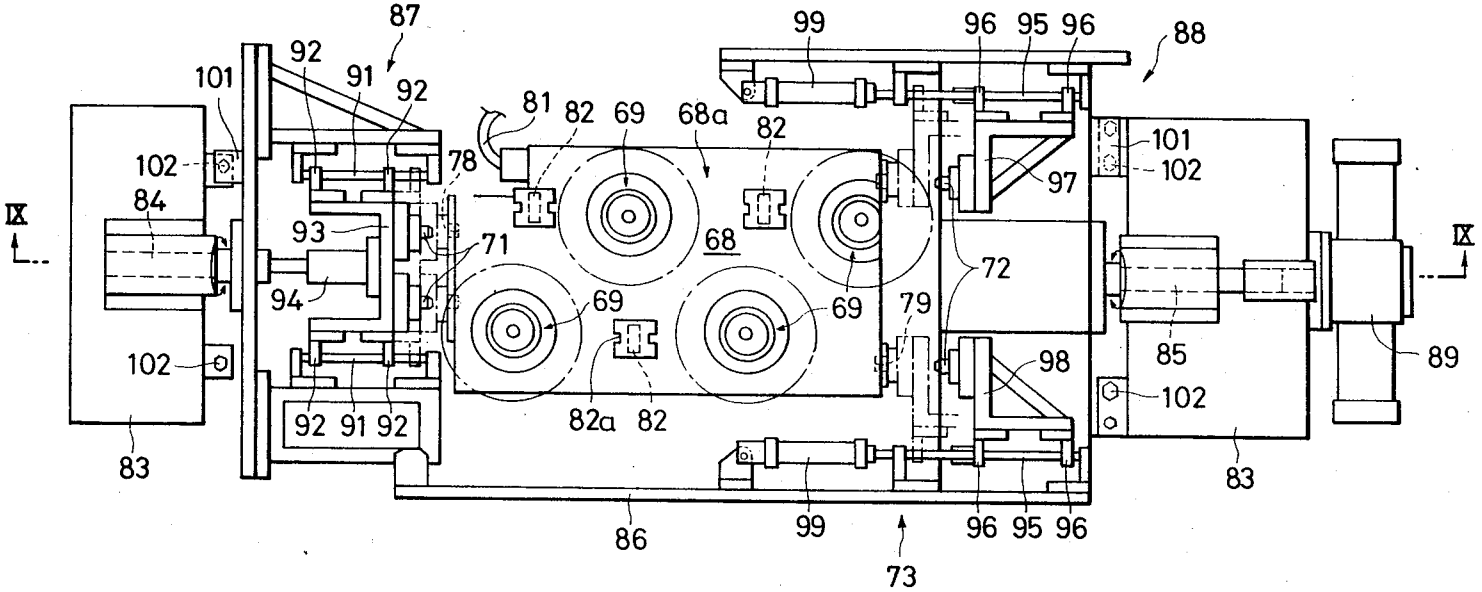
FIG. 8 is a plan view of a inverting device.
Figure 9:
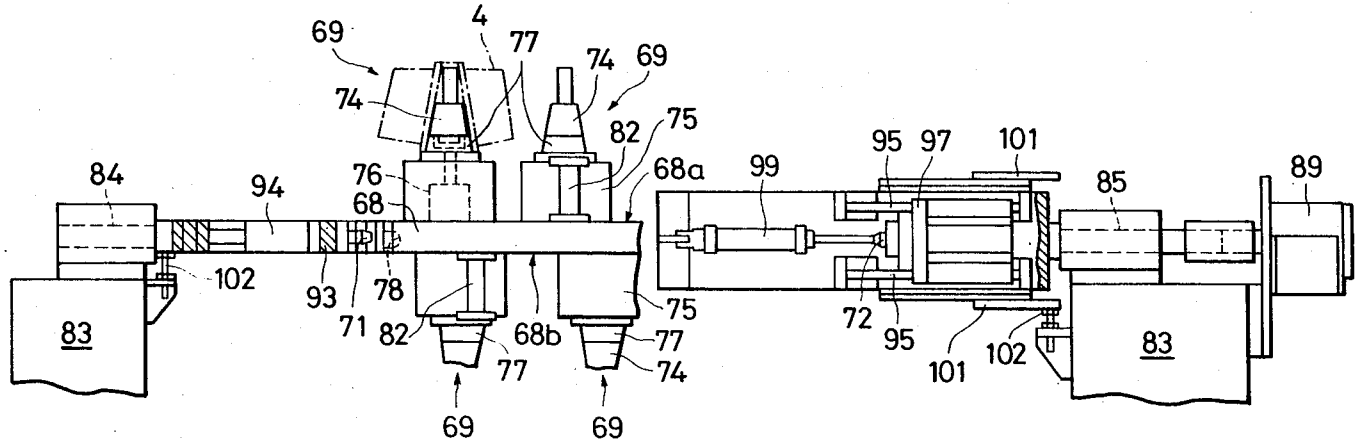
FIG. 9 is a sectional view taken on line IX—IX of FIG. 8.
Figure 10:
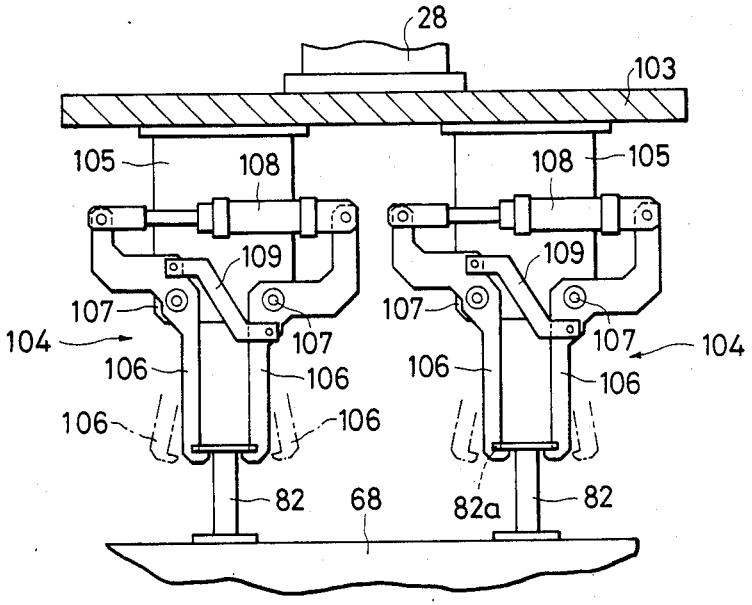
FIG. 10 is a longitudinal sectional side view of a gripper for gripping and transporting an inverting bed.

Next, the cone inverting device 11 will be described with reference to FIGS. 8 and 9. The inverting device 11 in this embodiment comprises an inverting bed 68 having the face and the back **68*a*, 68*b*, the face 68*a* being provided with four holders 69 for cones 4 and the back 68*b* being provided with three holders 69, and a turning and driving device 73 holding the inverting bed 68 by pins 71 and 72** from both sides thereof rotatable about a horizontal axis, which will be further described hereinafter.

That is, the inverting bed 68 is designed so that four holders 69 for the face thereof and three holders 69 for the back thereof as described above are disposed on an approximately rectangular base plate in the same arrangement as the arrangement of putting cones into the aforesaid empty cases 8A and 8B. In each holder 69, an intermediate portion 74 in the form of an approximately conical projection is moved up and down by the expansion of an air cylinder 76 with a base housing 75 and said upward and downward movements cause a rubber annular lower portion 77 to be expanded and contracted in a radial direction to thereby hold and release the cone 4. The base plate is formed in ends on both sides thereof with depressions 78 and 79 into which holding pins 71 and 72 of the turning and driving device 73 are fitted, and when the device 73 is driven under the state where the pins 71 and 72 are fitted into the depressions 78 and 79, the inverting bed 68 is turned and inverted about the horizontal axis. Reference numeral 81 designates an air pipe leading to an air cylinder 76 of the holder 69, said air pipe 81 being connected to the cantilever arm 22 of the robot so that all the holders 69 on the inverting bed 68 may be switched in holding and releasing at the same time by introduction and cutting-off of air into the air pipe 81. Reference numeral 82 designates a handle extended on the base plate for the purpose of gripping by the gripper 25. The handles 82 are arranged in the same manner for both the face and the back.

The turning and driving device 73 will now be described.

The device 73 comprises a turning frame 86 rotatably supported on a bed 83 by means of horizontal shafts 84 and 85, devices 87 and 88 for moving forward and backward holding pins 71 and 72 provided on the turning frame 86, and a driving device for the turning frame comprising a rotary actuator 89 connected to one horizontal shaft 85. The turning frame 86 is formed into an approximately rectangular frame surrounding the inverting bed 68, and devices 87 and 88 for moving forward and backward holding pins as noted below are provided on both sides putting the inverting bed 68 therebetween.

More specifically, moving device 87, the holding pin 71 mounted on the front surface of a moving plate 93 provided horizontally movably through a guide bar 91 and a slide bearing 92 on the turning frame 86, and a single cylinder 94 for movement and driving is connected between the back of the moving plates 93 and the turning frame 86. In the other moving device 88, a pair of left and right moving plates 97 and 98 horizontally movable through a guide bar 95 and a slide bearing 96 are likewise provided on the turning frame 86, holding pins 72 and 72 are mounted on the front surfaces of the moving plates 97 and 98, respectively, and cylinders 99 for movement and driving are connected to the distal ends of the moving plates 97 and 98, respectively.

Reference numeral 101 designates stopper plates for locating turning extended on both sides of the turning frame 86. By abutment of the stopper plate 101 with a stopper bolt 102 on the bed 83, the inverting turning of the turning frame 86 (inverting bed 68) every accurate 180 degrees may be obtained.

While in the above-described inverting device 11, the face and the back **68*a* and 68*b* of the inverting bed 68 is utilized so that the holder 69 in which two kinds (kind A and kind B) different from each other are arrayed is mounted on the inverting bed 68, and the cones 4 of two kinds may be inverted by every turning of the inverting bed 68 at 180 degrees, it is to be noted that the inverting bed 68 is formed into a polygonal post more than a triangle post, and the holders 69 are provided on the sides in different arrangement, and when the thus formed inverting bed is turned and stopped every 120 degrees, 90 degrees or at angles other than said degrees by the turning and driving device, the cones 4** of more than three kinds may be inverted.

The gripper 25 for the inverting device 68 will now be described. This gripper 25 comprises a support frame 103 secured to the lower end of the arm 28 and three gripper units 104 suspended from the support frame 103. The gripper units 104 are in the same zig-zag arrangement with that of the handle 82 on the inverting bed 68.

In each gripper unit 104, a pair of catching levers 106 are swingingly journalled at 107 on a support plate 105 suspended from the support frame, and an opening and closing driving cylinder 108 is mounted on the upper end of the lever 106. The end of the lever 106 is in engagement with a depression 82*a* formed in a flange portion of the handle 82. Reference numeral 109 designates a link connected between the levers 106.

The gripper 104 is not limited to the construction as described above but various other grippers capable of holding the handle 82 on the inverting bed 68 may be employed.

The outer peripheral configuration (FIG. 4) of the above-described gripper 24 as view in plan and the outer peripheral configuration (FIG. 8) of the inverting bed 68 as viewed in plan are formed to be slightly smaller than the size of a frontage of the empty cases 8A and 8B so that they may be moved into the empty cases 8A and 8B under the state wherein the cones 4 are held.

Since the system of this embodiment is designed as described above, for example, the system may be operated in the following order to successively encase various diameters of cones.

Cones 4A of kind A are aligned and prepared in the aligning and supplying device 7 as mentioned above, and empty boxes 8A of kind A are stopped at a predetermined position (stopper cylinder 53) of the supplying belt conveyor 9. Then, in encasing the cones 4A of kind A, the gripper units 44 are first switched to the pitch array for the kind A.

The gripper 24 moved onto four upright cones 4A arranged on the conveyor 2, and the cones 4A on the conveyor 2 are held at a time by the gripper units 44 while maintaining them in a zig-zag aligned state. After the cones 4A have been raised, they are carried to the inverting device 11 and transferred to the holder 69 on the inverting bed 68 with the face 68*a* held by the turning and driving device 73, that is, the surface 68*a* on the side where the holders 69 in the number of four are disposed directed upwardly.

The empty bobbin tray 36A with the cones 4A removed from the gripper 24 is ejected to the carrying conveyor 3 immediately after the withdrawal of the stopper cylinder 6, and subsequently, four cones 4A of kind A are delivered onto the aligning conveyor 2 for ready to align.

The inverting bed 68 which has received the cones 4A is reversely rotated through 180 degrees by the rotary actuator 89 after the holder 69 has assumed the cone holding state. The cone 4A on the inverting bed 68 are substantially placed in inverted state by said inversion of the bed 68. During that period, the partitioning plate 14A for the empty cases 8A of kind A is attracted and raised from the stacking box 12A by the attraction head 26 and transferred to the bottom of the empty case 8A.

Under the above-described state, four upright cones 4A are placed on the aligning belt conveyor 2, and four inverted cones 4A are held on the inverting bed 68. Subsequently, the movable frame 18 assumes the position indicated by the solid line in FIG. 1 and the upright cones 4A are gripped up by the gripper 24 and the inverted cones 4A along with the inverting bed 68 are gripped up by the gripper 25.

Thereafter, four upright cones 4A are placed into the case 8A (arrangement of which is shown in FIG. 7), and the gripper 25 holding the inverting bed 68 moves onto the empty case 8A to insert four inverted cones 4A into the case 8A along with the inverting bed 68. The holder 69 is then released, and the inverted cone 4A is accurately inserted into and placed between the upright cones 4A previously placed.

By the operation as described above, the first row of upright cones 4A and inverted cones 4A are encased in the accurate zig-zag arrangement. Subsequently, the partitioning plate 14A is placed on the first row of cones 4A within the box 8A, and then the above-described operation is repeated to receive the second row of upright cones 4A and inverted cones 4A.

The case 8A already subjected to encasing is unloaded from the conveyor 9 upon the withdrawal of the stopper cylinder 53.

Next, encasing of cones 4B of kind B will be described. Also in this case, likewise the case of the above-described kind A, cones 4B of kind B are fed onto the aligning belt conveyor 2 for preparation of alignment and empty case 8B for kind B is prepared at the predetermined position of the supplying belt conveyor 9. The thereafter operations are substantially similar to the case of the former. However, with respect to the array of the gripper units 44 of the gripper 24, the pitch changing device 43 is operated as noted below to effect encasing.

That is, when the gripper 24 moves onto three upright cones 4B placed on the conveyor 2 and the cones 4B on the conveyor 2 are held by the gripper units 44 while maintaining the zig-zag arrangement, the arrangement of the gripper units 44 are effected as in the kind A and the pitch changing device 43 is operated as described above during the transfer of the cones to the inverting device 11 after they have been gripped and raised to switch the array of the gripper units 44 into the mode of kind B while holding the cones 4B. That is, as shown in FIG. 7, each cone 4B is widened through the amount W widthwise of the case on the gripper 24 and is biased lengthwise of the case through the amounts l1 l2.

Then, the cones 4B are transferred onto the reversing bed 68 of the reversing device 11 by the gripper 24 which has been changed in pitch for the kind B. In handling the cones 4B of kind B, the inverting bed 68 is preset in the back 68*b*, i.e., the surface 68*b* on the side where three holders 69 are arranged so as to be directed upwardly, and the upright cones 4B are transferred to the holder 69 on the back side.

The inverting bed 68 which has received the cones 4B is reversely turned through 180 degrees after the holder 69 has assumed a cone holding state, and the cones 4B are substantially placed in an inverted state. At the time when the inverting bed 68 has been turned, three upright cones 4B are placed on the aligning belt conveyor 2 and three inverted cones 4B are held on the inverting bed 68, and therefore, the movable frame 18 assumes the position as indicated by the solid line in FIG. 1 and the upright cones 4B are gripped up by the gripper 24 in a manner similar to that described previously and the inverted cones 4B are gripped up together with the inverting bed 68 by the gripper 25. However, the gripper units 44 of the gripper 24 are switched to the pitch for the kind B when being transported to the inverting device 11 for the first time cones, and therefore, prior to entry into the operation of gripping the upright cones 4B on the conveyor 2 for the second time, the pitch changing device 43 is operated to again place the gripper units 44 in the pitch arrangement for the kind A so that the upright cones 4B on the conveyor 2 are gripped up by the gripper 24 in the unit arrangement for the kind A, after which the gripper 24 is again returned to the pitch arrangement for the kind B.

The upright cones 4B gripped by the gripper 24 through the aforementioned operation are in the arrangement for the kind B, and the inverted cones 4B on the inverting bed 68 held by the gripper 25 are also in the arrangement for the kind B, and subsequently, the gripper 24 causes the upright cones 4B to be inserted into the empty case 8B while the gripper 25 causes the inverted cones 4B together with the inverting bed 68 to be inserted into the case 8B. At that time, the gripper unit 44 with no cone held thereon is being moved toward the inside of the case by the switching of the arrangement into the kind B, and therefore, the gripper unit 44 is free from trouble in impingement upon the peripheral edge of the case, as described above, when the upright cones 4B are inserted into the box.

By the aforesaid operation, the first row of upright cones 4B and inverted cones 4B are encased in an accurate zig-zag fashion with in the case, and subsequently, after the placement of the partitioning plate 14B, the aforesaid operation is repeated to encase the second row of cones 4B into the case.

In the system according to the above-described embodiment, as described above, the inverting bed 68 of the inverting device 11 is separable from the turning and driving device 73, the inverted cones 4A or 4B after the inversion are carried by the gripper 25 together with the inverting bed 68, and the handles 82 on the face and the back of the inverting bed are of the same arrangement and same construction. Therefore, the construction of the gripper 25 is extremely simple, which merely grips the handle 82, and the step of gripping the inverted cones 4A or 4B by gripper units corresponding thereto is omitted to reduce the time required and greatly reduce a possible trouble such as mis-gripping. The construction of the inverting device 11 and gripper 25 is not limited to those as described above.

Furthermore, the robot 16 is not limited to the cross coordinate type robot having a gate-type frame as described above but it may be of, for example, a multiarticulated type robot, a cylindrical coordinate type robot or the like mounted on the traverse vehicle, said robot being provided with the aforesaid grippers 24 and 25 and being moved between the aforesaid cone aligning and supplying device 7, the inverting device 11 and the case supplying belt conveyor 9.

As will be apparent from the above description, the encasing robot system according to the present invention, even when a number of and a multi-row of cone-like articles are encased, cone-like articles in an upright state and cone-like articles in an inverted state are collected by each row, gripped up, inserted and inverted whereby the upright and inverted articles may be charged into the cases alternately, without clearance and orderly. In addition, even if the arranging pitch into the case is switched due to the change in diameter of the articles to be handled, the encasing operation may be performed in quick correspondence to such change.

What is claimed is:

1. A robot system for encasing cone-like articles, the system comprising:

a robot movable along a path, an aligning and supplying device for aligning and supplying a plurality of cone-like articles along the path of the robot, and an inverting device for carrying and inverting said plurality of cone-like articles which are disposed along the path of the robot, said robot including:

a first gripper for gripping and carrying the cone-like articles aligned on the aligning and supplying device, and a second gripper for gripping and carrying the cone-like articles inverted on said inverting device, said first gripper having a pitch changing device for changing the pitch of the plurality of cone-like articles as the cone-like articles are gripped and carried from the aligning and supplying device to the inverting device, and said inverting device having a plurality of sets of article holders for holding the plurality of cone-like articles, each set of article holders being relatively spaced by a different pitch, one set of article holders having a pitch corresponding to the pitch of the cone-like articles carried by the first gripper.

2. The robot system as claimed in claim 1, wherein stacking boxes including partitioning cardboards are further disposed along the path of the robot.

3. The robot system as claimed in claim 1, wherein said cone-like articles are supplied on trays and wherein said aligning and supplying device for cone-like articles comprises:

a loading conveyor for storing the cone-like articles carried on trays, an aligning conveyor having triangular baffles for arranging in a zig-zag manner the trays with cone-like articles on the aligning conveyor, and a belt conveyor for discharging trays from which the cone-like articles have been removed.

4. The robot system as claimed in claim 3, wherein a stopper cylinder is provided at the foremost portion of the baffles and a gate which is actuated to be opened and closed at suitable intervals to feed desired numbers of cone-like articles to the aligning belt conveyor is provided at the end of the loading conveyor.

5. The robot system as claimed in claim 1, wherein said first gripper comprises:

a vertically movable arm, a support frame secured to the lower end of the arm, said pitch changing device being supported by the support frame, and a plurality of gripper units for holding the cone-like articles suspended from the pitch changing device.

6. The robot system as claimed in claim 5, wherein said pitch changing device comprises:

movable frames which are slidably supported on the support frame, each of said movable frames being provided with one or more gripper units, respectively, a first cylinder interposed between the movable frames, and second cylinders disposed between the gripper units supported on each of the movable frames, said second cylinders being operable to change the distance between the gripper units in a direction substantially perpendicular to the direction of movement of the first cylinder.

7. The robot system as claimed in claim 6, wherein the stroke of said first cylinder and the stroke of said second cylinder are designed to expand stepwise, whereby the arrangement of the gripper units can be changed.

8. The robot system as claimed in claim 1, wherein said inverting device comprises:

an inverting bed having a plurality of holder members for holding the cone-like articles and a turning and driving device for holding the inverting bed and inverting the inverting bed about a substantially horizontal axis.

9. The robot system as claimed in claim 1, wherein said inverting device comprises:

an inverting bed having a plurality of article loading surfaces, each of said surfaces being provided with a predetermined number of holders thereon, respectively, at least one handle secured on the inverting bed, said handle being engageable with the second gripper, and a turning and driving device for holding the inverting bed, said turning and driving device being rotatable about a horizontal axis.

10. The robot system as claimed in claim 9, wherein said turning and driving device includes:

a horizontal shaft coaxial with the horizontal axis of rotation of the turning and driving device, a turning frame surrounding the inverting bed and being connected to the horizontal shaft and having pins which are movable to engage and disengage with the inverting bed, and a rotary actuator connected to the horizontal shaft of the turning frame.

11. A method of encasing articles comprising the steps of:

aligning a first plurality of articles, transferring said first plurality of articles by a first gripper to an inverting station, said inverting station having a plurality of sets of article holders, each set of article holders being relatively spaced by a different pitch, modifying the relative spacing of said first plurality of articles during said transferring step so that the relative spacing of said first plurality of articles corresponds to the pitch of one of said sets of article holders, inverting said first plurality of articles at said inverting station, transferring said inverting first plurality of articles by a second gripper to an encasing station, encasing said first plurality of articles.

12. A method as in claim 11 further comprising the steps of:

aligning a second plurality of articles, transferring said second plurality of articles by said first gripper to said encasing station, and encasing said second plurality of articles.

13. An apparatus for encasing articles, comprising:

aligning means for aligning a plurality of articles, inverting means for inverting the plurality of articles, a first gripper for gripping and carrying the plurality of articles from the aligning means to the inverting means, a pitch changing device associated with the first gripper for changing the pitch of the plurality of articles as the plurality of articles are gripped and carried by the first gripper from the aligning means to the inverting means, and a plurality of sets of article holders associated with the inverting means for holding the plurality of articles, each set of article holders being relatively spaced by a different pitch, one set of article holders having a pitch corresponding to the pitch of the articles carried by the first gripper.

14. An apparatus as in claim 13 further comprising:

encasing means for encasing said plurality of articles, and a second gripper for gripping and carrying the plurality of articles inverted by said inverting means to the encasing means.

* * * * *